US007424241B2

(12) United States Patent
Shirakata

(10) Patent No.: US 7,424,241 B2
(45) Date of Patent: Sep. 9, 2008

(54) IMAGE FORMING APPARATUS WITH FILTERING FUNCTION

(75) Inventor: Jiro Shirakata, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 288 days.

(21) Appl. No.: 11/252,594

(22) Filed: Oct. 19, 2005

(65) Prior Publication Data

US 2006/0093394 A1 May 4, 2006

(30) Foreign Application Priority Data

Oct. 22, 2004 (JP) ..... 2004-308684

(51) Int. Cl.
*G03G 21/20* (2006.01)

(52) U.S. Cl. ..... 399/93

(58) Field of Classification Search ..... 399/92, 399/93

See application file for complete search history.

(56) References Cited

U.S. PATENT DOCUMENTS 4,530,589 A * 7/1985 Adams ..... 399/92
5,081,496 A * 1/1992 Takeda ..... 399/92
5,185,629 A * 2/1993 Iino et al. ..... 399/93
6,173,132 B1 * 1/2001 Kida et al. ..... 399/44
2007/0009283 A1 1/2007 Shirakata et al.

FOREIGN PATENT DOCUMENTS

JP 6-317 1/1994
JP 08171317 A * 7/1996
JP 11-161121 6/1999
JP 2000-330435 11/2000

* cited by examiner

*Primary Examiner*—Ryan Gleitz
(74) *Attorney, Agent, or Firm*—Fitzpatrick, Cella, Harper & Scinto

(57) ABSTRACT

An image forming apparatus includes a first air flow channel that has an air inlet, an exhaust outlet and filters. As air in the image forming apparatus is externally discharged along the first air flow channel, byproducts generated in the image forming apparatus are removed by the filters. The image forming apparatus also includes a second air flow channel, which also has an air inlet, an exhaust outlet and a filter for removing byproducts. With this configuration, the byproducts generated in the image forming apparatus can be recollected.

8 Claims, 6 Drawing Sheets

IMAGE FORMING APPARATUS WITH FILTERING FUNCTION

BACKGROUND OF THE INVENTION

1. Field of the Invention

The present invention relates to an image forming apparatus, such as a full color printer adapted to use an electrophotographic system. Particularly, the present invention relates to an image forming apparatus that includes air flow channels for the removal, from the interior of the image forming apparatus, of undesirable operational byproducts.

2. Description of the Related Art

Conventionally, filters for the removal of undesirable operational byproducts, such as ozone, have been provided for exhaust systems of image forming apparatuses to cleanse the air discharged from the apparatuses, and to remove, or to reduce, irritating emissions and odors carried by the discharged air. Recently, however, since there has been an increase in the number of requests for a more comfortable office environment, a corresponding demand has arisen for exhaust filters that can highly effectively perform the removal function.

To satisfy this demand, the use of a plurality of filters has been proposed, as described in Japanese Patent Laid-Open No. Hei 11-161121 and No. 2000-330435. Further, as is described in Japanese Patent Laid-Open No. Hei 6-317, to improve the performance of a filter, the air flow directed toward the effective portion of the filter is equalized. In addition, as something that directly influences office environment, there is a proposal, promulgated in Japanese Utility Model Application No. 10-10771, according to which an air cleaner is attached to the exterior of a copier, such as to the lower portion of the sorter.

However, when the performance required of a filter is increased, as in the conventional case, the quantity of byproducts discharged within a range that conforms to environmental regulations varies, depending on the conditions governing the usage of the image forming apparatus. Therefore, in accordance with such conditions that govern the usage of an image forming apparatus, the concentration of byproducts around the periphery of the apparatus will fluctuate. It is preferable, therefore, that this fluctuation be reduced, in order to satisfactorily cope with future environmental regulation standards, which are expected to be stricter.

On the other hand, according to another conventional arrangement for which an air cleaner is provided, increased space for installing the image forming apparatus is required.

It is preferable, therefore, that a large space not be required for the installation of an image forming apparatus, and that, regardless of the conditions governing its use, the concentration of the byproducts discharged into its peripheral area be reduced.

SUMMARY OF THE INVENTION

The present invention can provide an image forming apparatus for reducing the concentration, around the periphery of the image forming apparatus, of byproducts discharged by the image forming apparatus.

In one aspect, the present invention is directed to an image forming apparatus including a housing having an interior, image forming means, disposed in the housing, for forming an image on a recording medium, a first air flow channel, including a first air inlet, a first exhaust outlet used for the external discharge of air from the interior of the housing, and a first filter used to remove from the air byproducts generated by the image forming means, the air and the byproducts generated by the image forming means being guided to the first exhaust outlet, and a second air flow channel, including a second air inlet, a second exhaust outlet, and a second filter used to remove from the air the byproducts generated by the image forming means.

In another aspect, the present invention relates to an image forming apparatus including a housing, image forming means, disposed in the housing, for forming an image on a recording medium, first filtering means for filtering air within the housing and exhausting the filtered air externally of the housing, and second filtering means for drawing air from a first area that is at an upper region of the housing and external to the housing, filtering the drawn air, and exhausting the drawn air externally of the housing to a second area other than the first area.

Further features of the present invention will become apparent from the following description of exemplary embodiments (with reference to the attached drawings).

DESCRIPTION OF THE EMBODIMENT

Figure 1:
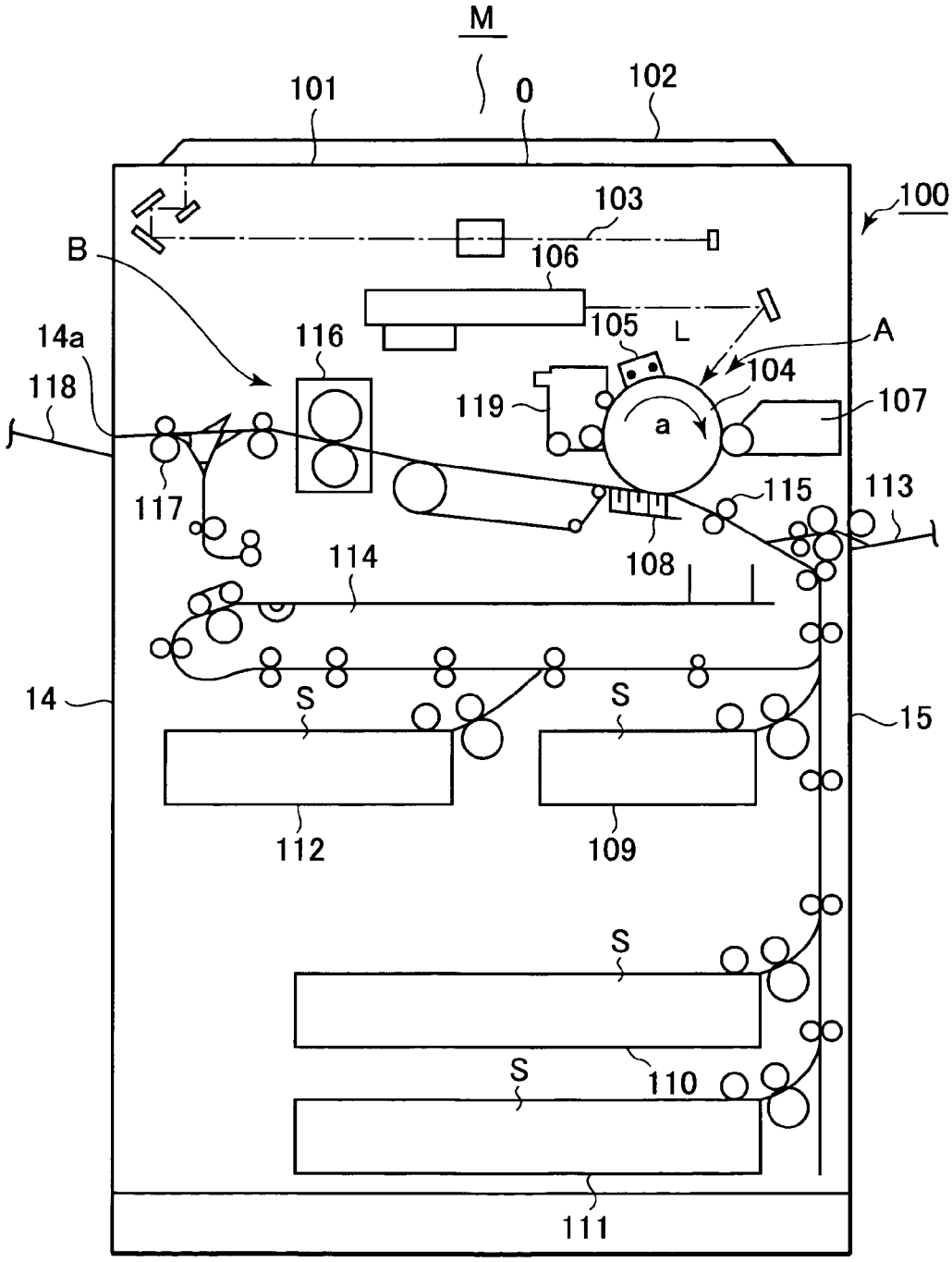
FIG. 1 is a schematic front, vertical cross-sectional view of the configuration of an image forming apparatus to which the present invention can be applied.

The preferred embodiment of the present invention will now be described while referring to the accompanying drawings. In the drawings, the same reference numerals are employed to denote components having the same configurations or the same functions, and repetitive explanations for them are avoided.

An image forming apparatus M for which the present invention can be applied is shown in FIG. 1. The image forming apparatus M is an electrophotographic printer, and FIG. 1 is a schematic vertical cross-sectional view of the configuration of this printer (hereinafter referred to as an "image forming apparatus") M.

An original glass plate or table 101 is located on the top of a main body 100 of the image forming apparatus M. An original ○ is mounted on the original glass plate 101, image face down, and aligned with a predetermined reference. Then, pressure is applied to the thus mounted original ○, from above, by an original pressing plate 102. As a result, the original ○ is held so its image face closely contacts the original glass plate 101.

Upon the depression of a copy start key (an image forming start button) on a console panel provided on the upper front face of the main body 100, an image photoelectric reading apparatus (reader section) 103, which includes an optical moving system, is activated. Through the performance of this operation, the image face of the original ○ mounted on the original glass plate 101 is photoelectrically scanned and image data are obtained. An automatic original feeding device (ADF or RDF) may also be mounted above the original glass plate 101, and automatically feed originals ○ to the original glass plate 101.

An image forming section A and an image forming section B, which can comprise image forming means are located below the photoelectric reading apparatus 103. An image bearing member of a rotary drum type (hereinafter referred to as a "photosensitive drum") 104 is provided for the image forming section A. The photosensitive drum 104 is rotated by drive means (not shown) at a predetermined processing speed (a peripheral speed) in the direction indicated by an arrow a. While being rotated, the surface of the photosensitive drum 104 is uniformly electrified by a electrifying apparatus 105 to a predetermined polarity and potential.

On the surface of the photosensitive drum 104, once it has been uniformly electrified, an electrostatic latent image is formed by an exposing apparatus 106 that serves as image writing means and, in this embodiment, is a laser scanner. In accordance with an instruction received from a controller (not shown), the laser scanner outputs a laser beam L modulated in accordance with a time series electric digital pixel signal of the image data photoelectrically scanned by the photoelectric reading apparatus 103. The output laser beam L exposes the uniformly electrified face of the rotating photosensitive drum 104, and then, charges are removed from the surface of the photosensitive drum 104 and an electrostatic latent image, based on the image information, is formed thereon.

Thereafter, a developing apparatus 107 attaches toner to the electrostatic latent image on the photosensitive drum 104, and a toner image is developed. At a transfer position between the photosensitive drum 104 and a transfer charging device 108, the toner image is transferred to a recording material S that has been conveyed thereto by a feeding/conveying apparatus. In this embodiment, the feeding/conveying apparatus includes either a first, second, third or fourth sheet feeding cassette 109, 110, 111 or 112, a manual feeding tray 113 or a reversing and re-feeding unit 114. The recording material S is selectively fed from one of these sections, and is fed, by registration rollers 115, to the transfer position in synchronization with the photosensitive drum 104 bearing the toner image. Then, at the transfer position, the toner image is transferred from the photosensitive drum 104 to the recording material S by the transfer charging device 108, and thereafter, the recording material S is separated from the surface of the photosensitive drum 104.

After the recording material S has been separated from the surface of the photosensitive drum 104, residual toner (transfer residual toner) on the photosensitive drum 104 is removed by a cleaning apparatus 119 to prepare for the next image forming process.

The recording material S separated from the photosensitive drum 104 is conveyed to a fixing apparatus 116, arranged in the image forming section B, which uses heat and pressure to fix the toner image to the surface of the recording material S. After the toner image has been fixed thereto, the recording material S is conveyed by discharge rollers 117 and is discharged through a discharge sheet port 14*a* to a discharge sheet tray 118 outside the main body 100. Through this processing, the image forming for the obverse face (the first side) of one recording material S is completed. The image forming means is constituted by the image forming section A and the image forming section B.

When double-sided image forming is performed, the recording material S, after the image has been fixed to one side, enters the reversing and re-feeding unit 114 and is reversed. Thereafter, the recording material S is again fed to the transfer position and a toner image is transferred to its reverse face (the second side). Then, the recording material S is again passed through the fixing apparatus 116. Following this, the recording material S, as a double-sided copy, is discharged to the discharge sheet tray 118 by the discharge rollers 117.

Figure 2:
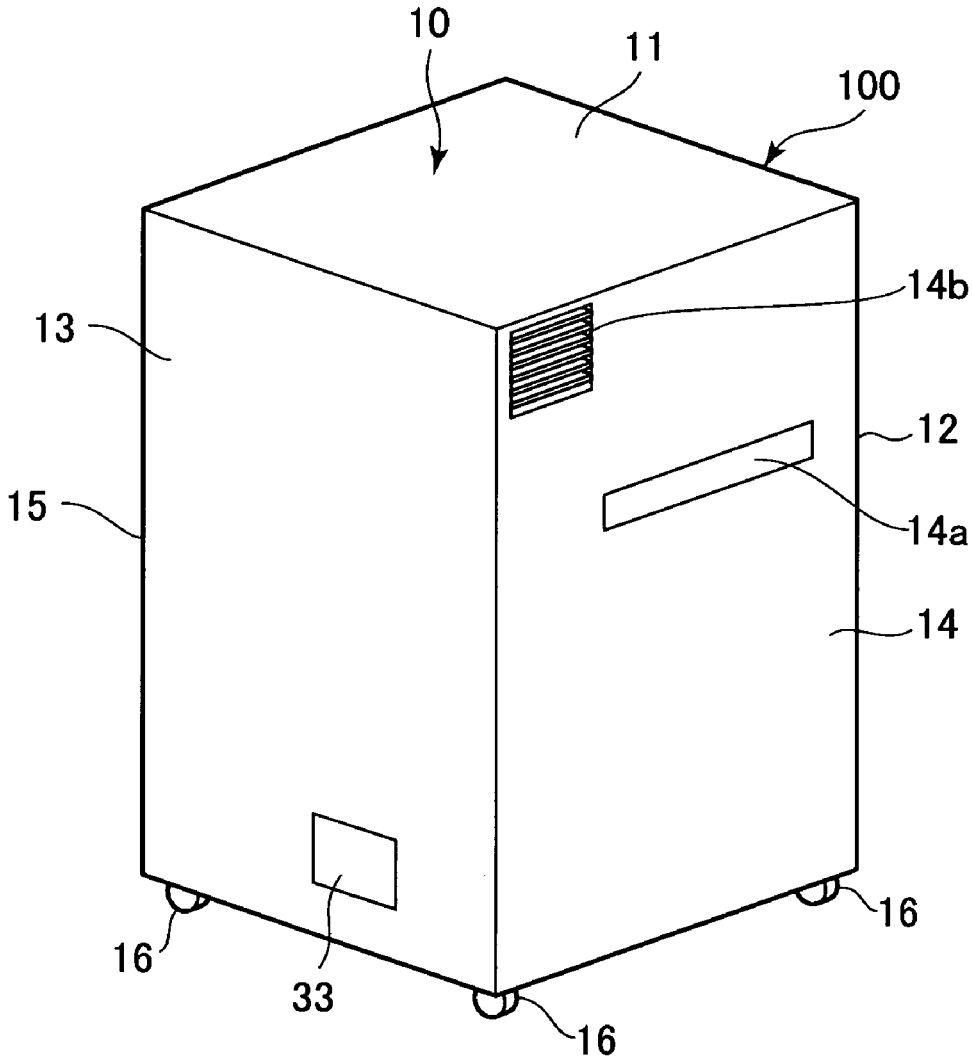
FIG. 2 is a left rear, upper oblique perspective view of the main body of the image forming apparatus.
Figure 3:
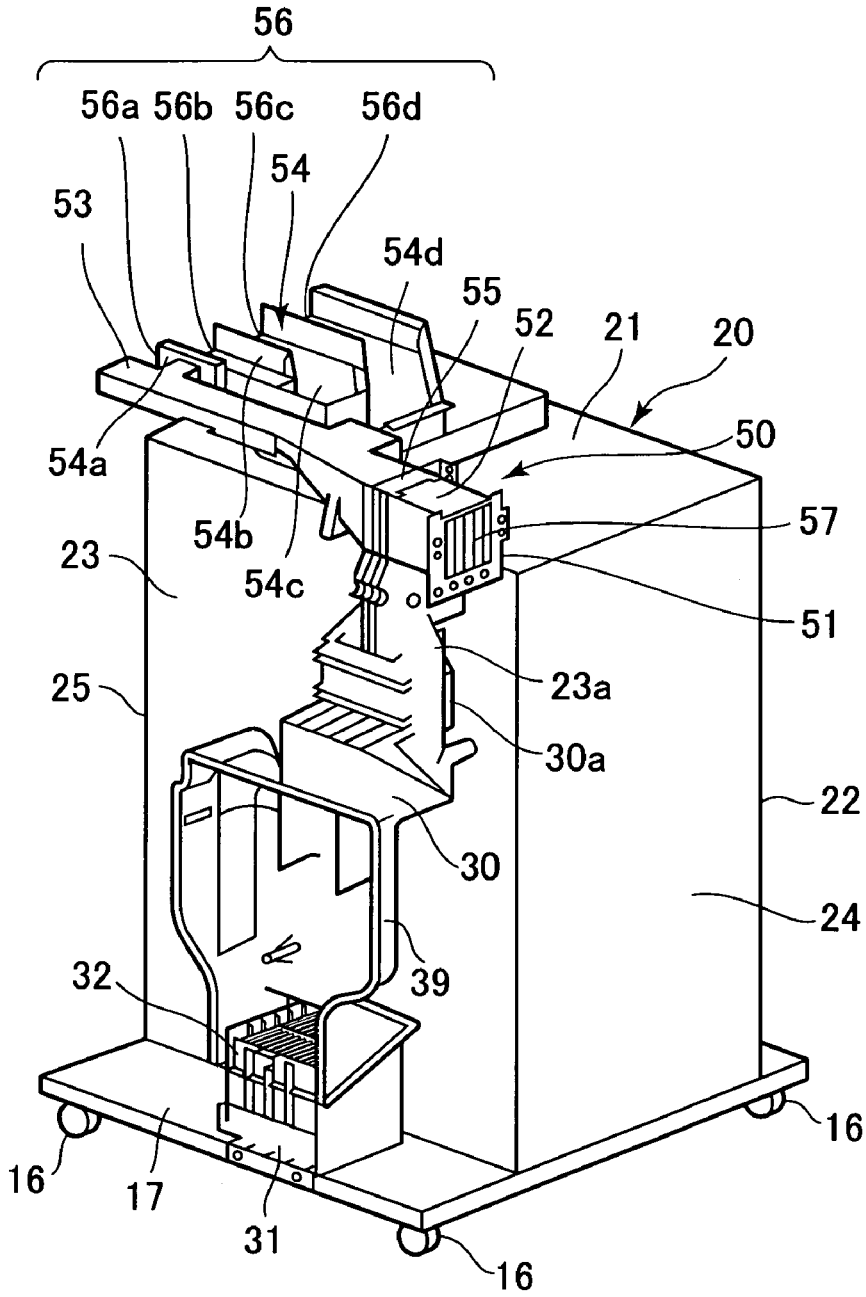
FIG. 3 is a left rear, upper oblique perspective view of the main body of the image forming apparatus with the external cover removed.
Figure 4:
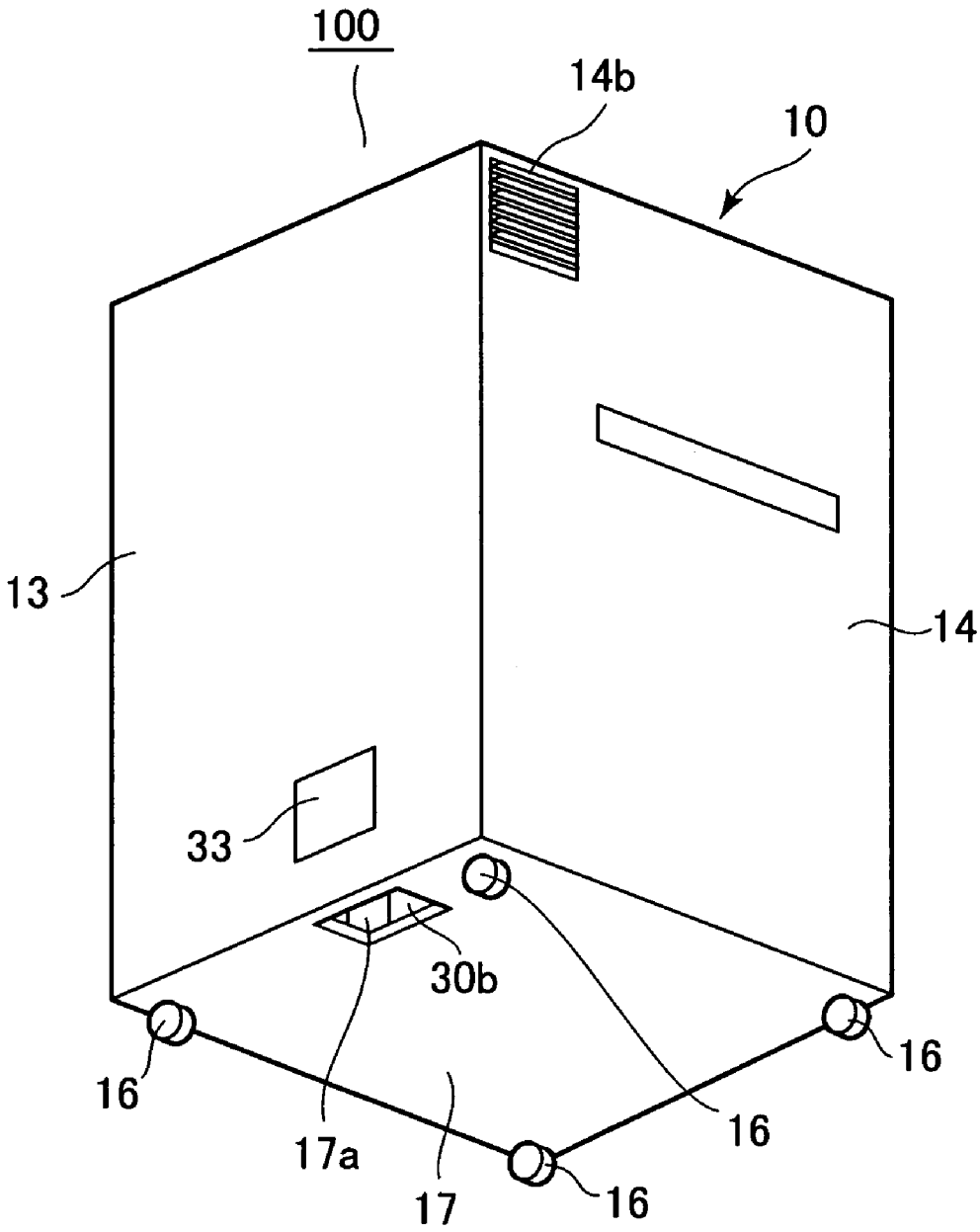
FIG. 4 is a left rear, lower oblique view of the main body of the image forming apparatus.

FIG. 2 is a left rear, upper oblique perspective view of the main body 100. FIG. 3 is a view of the state wherein an external cover 10, which is shown in FIG. 2, has been removed from the main body 100. And FIG. 4 is a left rear, lower oblique view of the main body 100. As shown in FIGS. 2 and 4, the box-shaped external cover 10 forms the upper and side walls of the main body 100. The outer sides and top external cover 10 are like a rectangular parallelepiped formed of an upper cover (top board) 11, a rear cover 13, a front cover 12 and a left cover 14 and a right cover 15, which are side covers. In the lower portion of the main body 100, a bottom plate 17 is supported by casters 16 located at four corners. Further, as shown in FIG. 3, a box-shaped engine cover 20 is mounted on the bottom plate 17. The engine cover 20 is like a rectangular parallelepiped formed of an upper plate 21, a front side plate 22, a rear side plate 23, a left side plate 24 and a right side plate 25. The image forming section A, which forms an unfixed image on a recording material S, e.g., the photosensitive drum 104, the developing apparatus 107 and the cleaning apparatus 119 in FIG. 1, is arranged inside the engine cover 20. In addition, the image forming section B including the fixing apparatus 116, the sheet feeding cassettes 109 to 112 and the reversing and re-feeding unit 114 are also arranged within the engine cover 20. The section inside the engine cover 20 is hereinafter referred to as an engine section, as needed.

Space is formed between the rear cover 13 of the external cover 10 and the rear side plate 23 of the engine cover 20, and in this space, a first air flow channel (hereinafter referred to simply as an "air flow channel") 30 in FIG. 3 is extended substantially vertically. A through-hole 23*a* is formed in the upper portion of the rear side plate 23 at a position corresponding to the image forming section B. The air flow channel 30 has a first air inlet (hereinafter referred to simply as an "air inlet") 30*a* at a position corresponding to the through-hole 23*a*. While the air inlet 30*a* is present in the upper portion of the air flow channel 30, a duct 39 is vertically extended in the intermediate portion of the air flow channel 30, and as shown in FIG. 4, a first exhaust outlet (hereinafter referred to simply as an "exhaust outlet") 30*b* is present in the lower portion. A through-hole 17*a* is formed in the rear portion of the bottom plate 17 and is vertically extended. The exhaust outlet 30*b* of the air flow channel 30 is located at a position corresponding to the through-hole 17*a*, and an exhaust fan 31 is arranged immediately above the exhaust outlet 30*b*, as shown in FIG. 3. Further, when the rear cover 13 is attached to the external cover 10, the air flow channel 30 is substantially sealed from the through-hole 23*a* in the rear side plate 23 to the through-hole 17*a* in the bottom plate 17 shown in FIG. 4.

With the air flow channel 30 thus arranged, when the exhaust fan 31 rotates, air near the image forming section A and the image forming section B is impelled through the through-hole 23*a* in the rear side plate 23 and the air inlet 30*a*, descends along the duct 39, and is discharged through the exhaust outlet 30*b* and the through-hole 17*a* to the space between the bottom plate 17 and the floor (the face the casters 60 contact).

A filter unit 32 is located above the exhaust fan 31. The filter unit 32 is provided to remove byproducts, such as bad smelling byproducts and ozone, from air that is discharged from the image forming section A and the image forming section B. When an auxiliary rear cover 33 is removed from the lower portion of the rear side plate 13 in FIG. 2, the filter unit 32 can be separated as a unit, shown in FIG. 5, from the main body 100.

Figure 5:
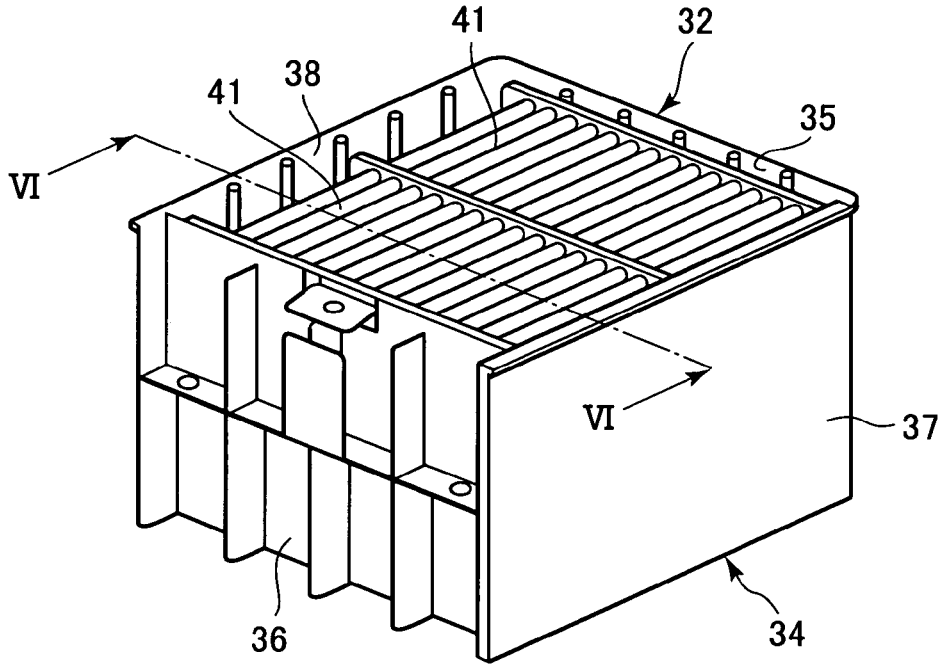
FIG. 5 is a left rear, upper oblique perspective view of a filter unit.
Figure 6:
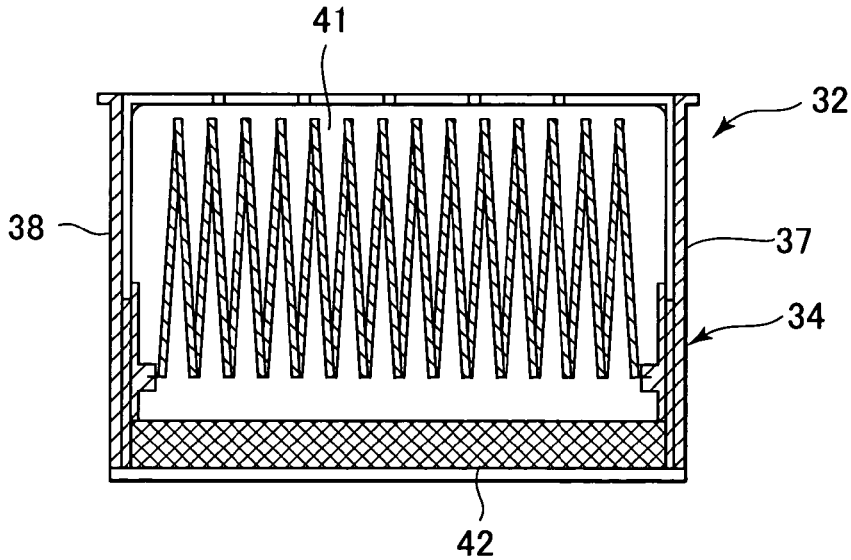
FIG. 6 is a view taken along section line VI-VI in FIG. 5.

The filter unit 32 is shown in FIGS. 5 and 6. FIG. 5 is a view of the filter unit 32 taken in the same direction as in FIG. 3. FIG. 6 is a view of the filter unit 32 taken along section line VI-VI, in FIG. 5. The filter unit 32 includes a filter case 34 and two types of filters 41 and 42 (see FIG. 6). As shown in FIG. 5, the filter case 34 includes a front plate 35, a rear plate 36, a left plate 37 and a right plate 38, and both the upper portion and the lower portion are open. As shown in FIG. 6, the two types of filters 41 and 42 are stored inside the filter case 34, and as shown in FIG. 5, the filters 41, which have the same shape, are adjacently arranged. Each of the filters 41 is an adsorption flatus filter that adsorbs materials, and is formed by bending like bellows, or by pleating, and activated carbon particles are sandwiched between two non-woven fabrics. The filters 41 are filters for absorbing materials. The filter 42 is a catalyst ozone filter that decomposes and removes materials, and is formed by applying a manganese dioxide catalyst to an aluminum honeycomb base material. The filter 42 is a catalyst filter. The filters 41 are located in the upper portion and the filter 42 is located in the lower portion of the filter case 34. Thus, the filters 41 and 42 can be easily exchanged, as needed, by opening the auxiliary rear cover 33 and extracting the filter unit 32.

Figure 7:
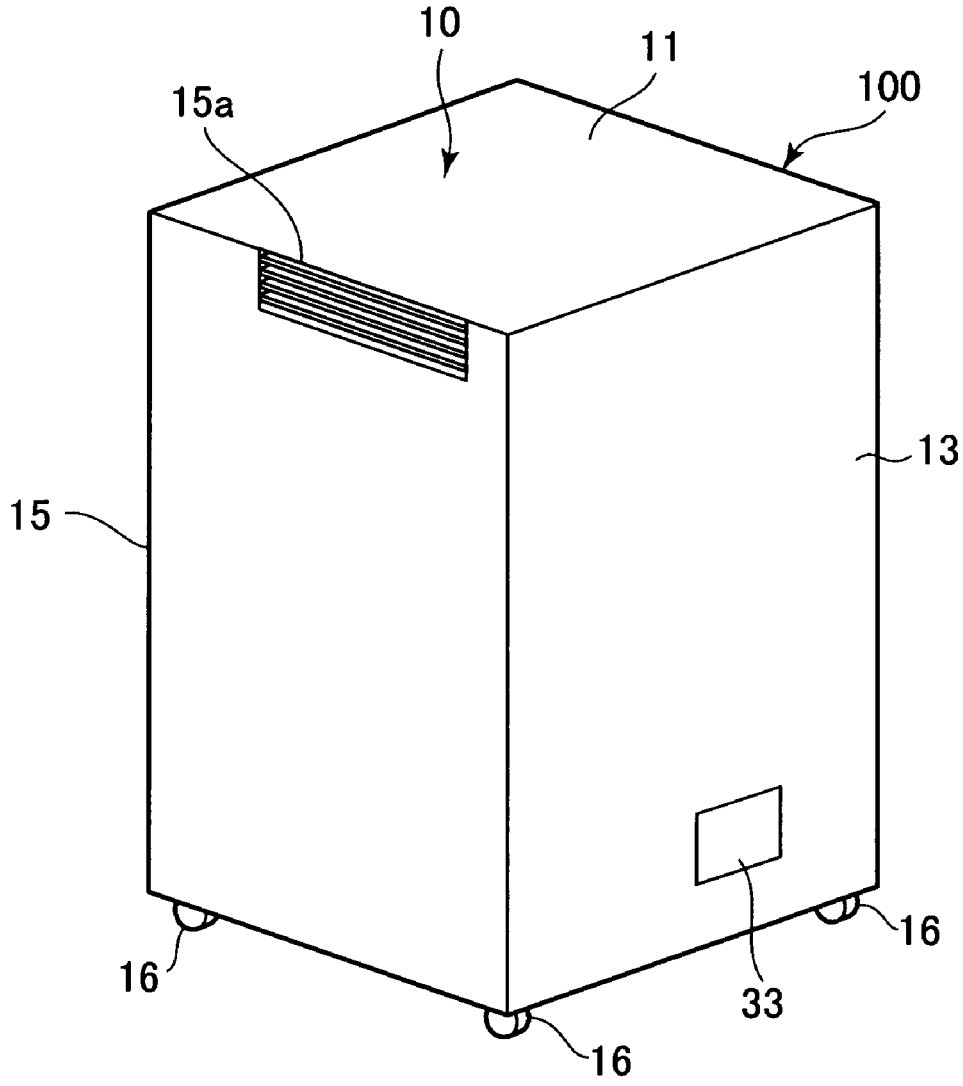
FIG. 7 is a right rear, upper oblique perspective view of the main body of the image forming apparatus.

The image forming apparatus M of this invention includes not only the air flow channel 30, but also a second "air flow channel (hereinafter referred to simply as an "air flow channel") 50, which is provided independent of the first air flow channel. In this embodiment, the air flow channel 50 is extended almost horizontally (transversely), and air flows along it substantially from the left to the right. As shown in FIG. 2, a through-hole 14*b*, which is formed of multiple horizontal slits, is formed in the upper rear portion of the left side plate 14 of the external cover 10. Whereas, on the other hand, as shown in FIG. 7, a through-hole 15*a*, which is formed of multiple longitudinally long slits, is formed in the upper portion of the right side plate 15. The air flow channel 50 has a second air inlet (hereinafter referred to simply as an "air inlet") 51 at the location corresponding to the through-hole 14*b* and a second exhaust outlet (hereinafter referred to as an "exhaust outlet") 56 at the location corresponding to the through-hole 15*a*. To the right of the air inlet 51, ducts 52 and 53 are extended to the right, and a duct 54 is extended across the front of the duct 53. The duct 54 is divided into four duct segments 54*a*, 54*b*, 54*c* and 54*d*, along which air from the duct 53 is introduced to the front and further to the right.

As shown in FIG. 3, a flatus filter 57 is attached in the vicinity of the air inlet 51, and an intake fan (blowing means) 55 is arranged immediately downstream of the flatus filter 57.

Since the flatus filter 57 is located in the vicinity of the air inlet 51, air drawn through the air inlet 51 passes through the flatus filter 57 with great force, so that the filtering of the air is ensured. Further, the degree of freedom in the design for the downstream side of the filter 57 is increased. Furthermore, since the intake fan 55 and the flatus filter 57 are located near each other, air can be easily transmitted to the flatus filter 57, which resists the flow of air, and the distance between the flatus filter 57 and the intake fan 55, whereat the pressure in the duct becomes the highest and strictly controlled sealing is required, can be reduced. Accordingly, the structure can be simplified.

The flatus filter 57 has the same structure as the flatus filter 41 provided for the air flow channel 40. That is, the flatus filter 57 is formed by bending or pleating two non-woven fabrics between which activated carbon particles are sandwiched. The flatus filter 57 is detachable from the main body 100, and the ducts 52, 53 and 54 of the air flow channel 50, located between the air inlet 51 and the exhaust outlet 56, are isolated from the other components of the main body 100. That is, the air flow channel 50, except for the air inlet 51 and the exhaust outlet 56, are substantially tightly closed. Further, a filter having the same structure as the filter 41 may be provided downstream of the flatus filter 57.

Since the air flow channel 50 is separated from the engine section, air discharged from the air flow channel 50 is always cleaner than the atmosphere around the main body 100 of the image forming apparatus M. That is, air discharged from the air flow channel 50 is cleaner than the air drawn in through the air inlet. Thus, when the air flow rate in the air flow channel 50 is increased, the environment in the image forming apparatus M can effectively be improved.

The actions taking place within the first air flow channel 30 and the second air flow channel 50, which have the above described structures, will now be described.

When the above described image forming operation is started, the engine section, including the image forming section A and the image forming section B, generates byproducts, such as ozone and bad smelling products, due to the fixing heat. Air containing these byproducts is drawn through the air inlet 30*a* by the exhaust fan 31 in the air flow channel 30, and thereafter descends along the duct 39, passes through the filter unit 32, and is discharged at the exhaust outlet 30*b* into the open area beneath the bottom plate 17.

Since the air in the engine section is discharged along the air flow channel 30 in this manner, air is prevented from leaking to the outside through gaps in the main body 100, and inside the engine cover 20, the concentration of the byproducts is maintained so that it is equal to or lower than a predetermined value. Further, the byproducts contained in the air impelled through the air flow channel 30 are removed by the filters 41 and 42 of the filter unit 32. At this time, since ozone is an unstable material, almost all ozone is decomposed and removed by the filter 42.

However, the removal function for a specific byproduct may be deteriorated, depending on the usage conditions in the image forming apparatus M, e.g., when the service life of the filter of the air flow channel has almost expired or when images are to be formed sequentially. In such a situation, while the amount of a specific byproduct, such as one that is bad smelling, is reduced, still, a small amount of such a byproduct will be discharged outside the main body 100 with air from the exhaust outlet 30*b*. Since, however, this byproduct will be dispersed in the atmosphere surrounding the image forming apparatus M, it will be diluted and within a concentration range that conforms to the environmental regulations and that will not bother a user. However, when the image forming apparatus M is installed in a poorly ventilated, comparatively small area, the concentration will be increased, and it may not be possible to cope with stricter future environmental regulations.

As is described above, according to the present invention, the air flow channel 50 is provided in addition to the air flow channel 30, so that the concentration of byproducts can be reduced, even in the above-described situation. Because of the air flow channel 50, the concentration of bad smelling byproducts around the image forming apparatus M can be maintained at a low level, so that a user will not be irritated. Specifically, when air containing a tiny amount of a bad smelling material is discharged at the exhaust outlet 30*b* of the air flow channel 30, the temperature of the air will have been raised by fixing heat. And as a result, this air ascends along the left cover 14, which is the left face of the external cover 10 near the exhaust outlet 30*b*, and is dispersed. Thereafter, most of the ascending, dispersed air is drawn in through the air inlet 51 by the intake fan 55, through the through-hole 14*b* that is formed in the upper portion of the left cover 14, and into the air flow channel 50. Any bad smelling material is absorbed and removed from the air by the flatus filter 57, and the deodorized air is transmitted to the ducts 52 and 53 and guided to the duct segments 54*a* to 54*d* that are extended under the upper cover 11. In this manner, while a broad air curtain is formed, a moderate air stream is discharged from the air outlets 56*a* to 56*d*.

Since the photoelectric reading apparatus 103 (see FIG. 1) is mounted on the upper cover 11, the air curtain can effectively prevent the transmission of heat, generated by the engine section, to the photoelectric reading apparatus 103.

In the air flow channel 50, the duct 52, extending from the filter 57 to the intake fan 55, is tightly sealed. Thus, air in the main body 100 that does not pass through the filter 57 is prevented from mixing with air going to the intake fan 55. On the other hand, since the ducts 53 and 54 are located downstream of the intake fan 55 and the internal pressure is positive, even when a slight gap is present, air from the other portions of the main body 100 does not enter. Thus, the ducts 53 and 54 are roughly sealed, and have a low cost, simple structure. As described above, air can be discharged from the air flow channel 50 while bad smelling material generated in the main body 100 is satisfactorily removed from the air. That is, air can be discharged while the amount of bad smelling material impelled out through the air inlet 51 is appropriately reduced.

Furthermore, the air inlet 51 of the air flow channel 50 is located on the side of the left side plate 14, where the discharge sheet port 14*a* of the main body 100 is formed. With this arrangement, not only a byproduct discharged from the exhaust outlet 56, but also a byproduct that is attached to the recording material S, discharged at the discharge sheet port 14*a*, or a byproduct that is carried along by an air stream that accompanies the delivery of the recording material S can be efficiently absorbed and removed.

Since the air flow channel 50 is independent of the image forming means, air around the periphery of the main body 100 can be repetitively passed through the air flow channel 50. Therefore, an extremely small amount of a material that cannot be removed by passing through the air one time can be quickly reduced.

Generally, when the image forming apparatus M is installed in a very small room, the concentrations in the atmosphere around the main body 100 may be uneven because the image forming apparatus M acts as an obstruction like a wall. In this embodiment, however, since the air flow channel 50 is formed so it is transversely extended in the main body 100, air in the room can be circulated, and throughout the entire room, the concentration of a bad smelling material can be efficiently reduced.

As is described above, according to the invention, with a simple configuration that occupies only a small space, byproducts generated by an image forming apparatus can be effectively restricted, and a comfortable office environment can be provided.

According to this embodiment, multiple filters are provided in the air flow channels. However, the order in which the filters are arranged is not limited to that in the embodiment, and the filters may be arranged in the reverse order.

In this embodiment, the first air flow channel is located on the rear face side (side plate 13 side) of the image forming apparatus; however, the present invention is not limited to this structure. As another structure, the entrance of the first air flow channel may be located on the front face side (side plate 12 side), and the exhaust side may be located on the rear face side (side plate 13 side). According to this structure, since the first air flow channel extends from the front face side, via image forming means, to the rear face side, air is impelled from the image forming means side, and is guided to the exhaust side. With this structure, the same effects can be obtained as in the first-described embodiment.

In the above embodiment, only one entrance is provided for the first air flow channel; however, multiple entrances may be formed.

Furthermore, in the above embodiment, the first air flow channel impels air from the image forming unit and fixing unit. However, air near the fixing unit may be impelled first. In this case, in order to draw air from near the image forming unit, a third, additional air flow channel may be formed that has an air inlet and an exhaust outlet, so that the effects provided by the invention can be obtained.

In addition, so long as the second air flow channel is independent of the image forming means, the arrangement and the structure of the air flow channel are not limited to those in the embodiment, and specifically, a duct that penetrates an image forming apparatus can be employed as the second air flow channel.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2004-308684, filed Oct. 22, 2004, which is hereby incorporated by reference herein in its entirety.

What is claimed is:

1. An image forming apparatus comprising:

image forming device for forming an image on a recording medium;

a first duct for flowing air, including a first air inlet for sucking air from said image forming device, and a first outlet for exhausting air to an exterior of said image forming apparatus;

a first filter, disposed between said first air inlet and said first outlet, for removing byproducts generated by said image forming device;

a second duct for flowing air, provided independent of said first duct, including a second air inlet for sucking air from an exterior of said image forming apparatus, and a second outlet for exhausting air to an exterior of said image forming apparatus; and a second filter, disposed between said second air inlet and said second outlet, for removing byproducts generated by said image forming device, wherein said second air inlet is located at a side surface of said image forming apparatus, and a portion from which the recording material is discharged from said image forming apparatus is disposed on said side surface.

2. An image forming apparatus according to claim 1, wherein said second air inlet is located in an upper portion of said image forming device, higher than said first outlet.

3. An image forming apparatus according to claim 1, wherein said image forming device includes an image forming section for forming an unfixed image on a recording material, and a fixing section for thermally fixing the image on the recording material, and wherein said first duct is structured to discharge air from at least the fixing section.

4. An image forming apparatus according to claim 1, wherein said second duct extends along said image forming device.

5. An image forming apparatus according to claim 1, wherein said first filter is located in said first duct, downstream of said image forming device.

6. An image forming apparatus according to claim 1, wherein said second air inlet is located at a side surface of said image forming apparatus, said second outlet is formed at an opposite side surface of said image forming apparatus.

7. An image forming apparatus according to claim 1, wherein said first filter and said second filter absorb byproducts.

8. An image forming apparatus according to claim 1, further comprising a blowing fan being arranged along said second duct and disposed between said second outlet and said second filter.

* * * * *

UNITED STATES PATENT AND TRADEMARK OFFICE

CERTIFICATE OF CORRECTION

PATENT NO. : 7,424,241 B2
APPLICATION NO. : 11/252594
DATED : September 9, 2008
INVENTOR(S) : Jiro Shirakata It is certified that error appears in the above-identified patent and that said Letters Patent is hereby corrected as shown below:

ON THE COVER PAGE:

Item "(56) References Cited," under "FOREIGN PATENT DOCUMENTS," the second-listed document "JP 08171317 A * 7/1996" should read -- JP 8-171317 A * 7/1996 --.

Signed and Sealed this

Third Day of February, 2009

JOHN DOLL
*Acting Director of the United States Patent and Trademark Office*